US007287623B2

(12) United States Patent
Graham, Sr.

(10) Patent No.: US 7,287,623 B2
(45) Date of Patent: Oct. 30, 2007

(54) ADJUSTABLE TREE STAND WITH POWER DRIVE

(76) Inventor: Thomas E. Graham, Sr., P. O. Box 7127, Wilmington, NC (US) 28406

( * ) Notice: Subject to any disclaimer, the term of this patent is extended or adjusted under 35 U.S.C. 154(b) by 500 days.

(21) Appl. No.: 10/958,839

(22) Filed: Oct. 5, 2004

(65) Prior Publication Data

US 2005/0082119 A1 Apr. 21, 2005

Related U.S. Application Data

(60) Provisional application No. 60/511,531, filed on Oct. 15, 2003.

(51) Int. Cl.
*A63B 27/00* (2006.01)

(52) U.S. Cl. ..... 182/133; 182/134; 182/135; 182/136; 182/187; 182/188

(58) Field of Classification Search ..... 182/133–136, 182/87, 188, 116, 20, 113, 187; 74/502.6, 74/505, 89.45, 423, 502.4, 501.5 R
See application file for complete search history.

(56) References Cited

U.S. PATENT DOCUMENTS 3,485,320 A 12/1969 Jones
4,321,982 A 3/1982 Strickland
4,953,662 A * 9/1990 Porter ..... 182/135
4,995,475 A 2/1991 Berkbuegler
4,997,063 A 3/1991 Bradley
5,090,506 A 2/1992 Womack et al.
5,607,143 A 3/1997 Regal
5,954,158 A 9/1999 Concepcion
6,595,325 B2 * 7/2003 Ulrich ..... 182/136

* cited by examiner

*Primary Examiner*—Lanna Mai
*Assistant Examiner*—Matthew J. Smith
(74) *Attorney, Agent, or Firm*—MacCord Mason PLLC

(57) ABSTRACT

A tree stand with a seating section and a standing section, at least one of the sections having a frame with first and second sides, inner and outer ends, a first cable attachment arm with inner and outer ends along the first side, and a second cable attachment arm with inner and outer ends along the second side; a rotatable threaded rod mounted parallel to the first attachment arm; a releasable cable retainer including a channel for receiving the attachment arm and a threaded bore for receiving the threaded rod, the retainer being moveable along the first attachment arm upon rotation of the threaded rod; drive means for rotating the threaded rod; and a cable having a first end releasibly attachable to the connector and a second end attachable to the second attachment arm.

13 Claims, 7 Drawing Sheets

10
26
14
44
43
64
66
16
18
54
22
68
68
30
28
12
74
62
60

Flg. 2

Flg. 6

ADJUSTABLE TREE STAND WITH POWER DRIVE

This application claims the priority of U.S. Provisional Application No. 60/511,531, filed Oct. 15, 2003, entitled Adjustable Tree Stand With Power Drive.

BACKGROUND OF THE INVENTION (1) Field of the Invention

The present invention relates generally to a tree stand of the type used by hunters to ascend a tree and provide an elevated seat thereon, and in particular to a tree stand that can be adjusted as the hunter ascends or descends the tree to provide a level and secure platform.

(2) Description of the Prior Art

Tree stands used to provide an elevated seat for hunters are well known in the prior art. One type of stand, known as a climbing tree stand, is constructed of a seating section and a standing section. The sections are attached to a tree with the seating section being above the standing section. The hunter then raises the sections in an alternating, inchworm fashion to elevate the stand to the desired height on the tree.

Stand sections are releasibly secured to the tree by flexible attaching members that extend around the tree from one side of the stand section to the other side. U.S. Pat. Nos. 6,182,792; 5,234,076; and 5,097,925 are all examples of climbing tree stands using flexible cables as attaching members.

As a hunter climbs a tree, the decreasing diameter of the tree trunk causes the rear of each stand section to tilt downward. In order to level the stand and thereby minimize the risk of falling, the hunter must shorten the cable length. Similarly, as the hunter descends the tree, the cable must be lengthened to maintain the section level. While the prior art purports to provide various means for adjusting the cable length, no practical means of adjusting the cable without detaching the cable from the tree stand has heretofore been available.

SUMMARY OF THE INVENTION

The present invention is directed to a tree-climbing device for improving the ease and safety of tree climbing. The invention relates especially to a tree stand that can be readily adjusted to changes in trunk diameter when ascending or descending the tree, providing a secure platform that can be adjusted to a horizontal position to accommodate changes in tree trunk diameter.

Generally, the tree stand of the present invention is comprised of a standing section and a seating section. The standing section includes a frame with an inner end and an outer end connected by side members, and a platform supported on the frame. A tree gripper or gripping section, normally a V-shaped, toothed member, extends inwardly from the inner end of the frame. The seating section is similarly constructed with a frame having inner and outer ends connected by side members, and a tree gripping section extending inwardly from the inner end of the frame. Instead of a standing platform, the seating section includes a seat, which may be fixed or moveable, supported by the frame.

Tree stands of the above general configuration are known in the art. The present invention is specifically directed to a unique means for attaching tree stands of this general configuration to a tree so that the stand is securely attached, yet readily adjustable to accommodate changes in the tree diameter when the tree is being ascended or descended.

More specifically, each frame section of the present tree stand includes support or attachment arms on each side of the frame, a cable that is extendable around the tree trunk, a cable retainer for releasable attaching one end of the cable to an attachment arm, and an electrically or manually powered drive means for moving the cable retainer along the attachment arm to tighten or loosen the cable, thereby permitting secure locking of the cable at a desired length, yet enabling quick adjustment of the length of the cable while the tree stand is in use.

To minimize the projection of the cable from the attachment arm, and thereby reduce the risk of snagging, a surface of the attachment arm may include an axially aligned trough, e.g., a semi-circular trough, to receive the cable. As used herein, the term "cable" is intended to include various forms of cables and elongated flexible, straps or bands that are of a sufficient length to extend around an average tree from one attachment arm to the other. Exemplary cables include cords, ropes, woven straps, etc. Preferably, the cable is a twisted stranded wire with a smooth sleeve, such as a wear-resistant plastic sleeve.

The cable retainer is designed for slidable movement along an attachment arm. At least one end of the cable is releasibly attached to a cable retainer so that the area enclosed by the cable and the tree grippers on the inner end of the stand is increased or decreased as the cable retainer is moved along the attachment arm.

Generally, the drive means for each cable retainer is comprised of a rotatable threaded rod that is mounted parallel to the attachment arm. One end of the rod, preferably the inner end, is configured for attachment to a manually powered winder or hand crank, or an electrically powered drive means. For example, the drive means may include a rotatable handle attachable through gearing to the rod. The handle may be releasibly inserted into a chuck. Alternatively, a battery-powered electric motor may be used to reversibly rotate the chuck and rod.

Each cable retainer is comprised of a housing that includes a threaded bore for engagement with the threads of the threaded rod, a channel for slidably inserting the attachment arm through the cable retainer, and a locking means for releasibly attaching one end of a cable to the cable retainer. The housing may be comprised of upper and lower sections positioned above and below the attachment arm, respectively, and are attached to each other to form a slot or channel through which the attachment arm extends.

To releasibly attach one end of the cable to the cable retainer, the housing may include a bore for receiving a connector on one end of the cable, and a lock to releasibly secure the connector in the bore. The release means may be a pin that is moveable, either rotatably or longitudinally, between a release position and a locked position. The connector may, for example, include a circumferential groove into which the pin is inserted to lock the connector into the bore. It will be appreciated that other means known in the art for releasibly securing the end of a cable or similar item can be adapted for this purpose.

In order to provide additional security, the seating section of the tree stand may also include an adjustable safety rail that can be lowered for storage and transport, and raised when the tree stand is in use. Generally, the safety rail is comprised of a tubular outer U-shaped section with inner ends, and first and second pivotal inner arms attached adjacent the inner end of the frame, and slidably insertable into the U-shaped section inner ends. Support arms are pivotally attached between the frame and the U-shaped section. As the safety rail is raised, the pivotal arms telescope from the U-shaped section. A locking means, e.g., a spring-loaded button, is used to secure the safety rail in its raised position.

In operation, a climber places the tree gripping section of the standing section against a tree trunk, and loops the cable around the tree trunk. Usually, one end of the cable is already attached to the frame. The opposite end of the cable is then releasibly attached to the cable retainer. Next, the climber places the seating section waist high and directly above the standing section making sure that the seating section tree gripper is engaging the tree trunk.

To ascend the tree, the climber places his or her feet in a restraint extending across the standing section platform. The climber then rests his or her weight on the seat of the seating section while using his or her feet and legs to pull the standing section upward. The climber then stands and, using his or her hands, raises the seating section to a waist high position. The climber then sits and again raises the standing section with his or her feet and legs. This procedure is repeated until the desired height is reached.

The diameter of the tree trunk will decrease as the climber ascends the tree. The cable will, as a result, become looser, causing the outer end of the tree stand section, whether the standing section or the seating section, to tilt downward, potentially causing the climber to fall. To correct this problem with the present tree stand, the climber merely places the stand section in the desired level position, and rotates the threaded rod, either manually or with the electrical tool. Rotation of the threaded rod causes the cable retainer attached to the threaded rod to slide along the attachment arm toward the outer end of the tree stand until the cable is tightened around the tree. When descending the tree, the cable is loosened by the same procedure in reverse.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

The following description is specifically directed to the construction of the seating section of a tree stand. It will be understood, however, that the construction of the cable retainer and related elements used with the standing section also forming a part of the climbing tree stand of the present invention are identical.

Figure 1:
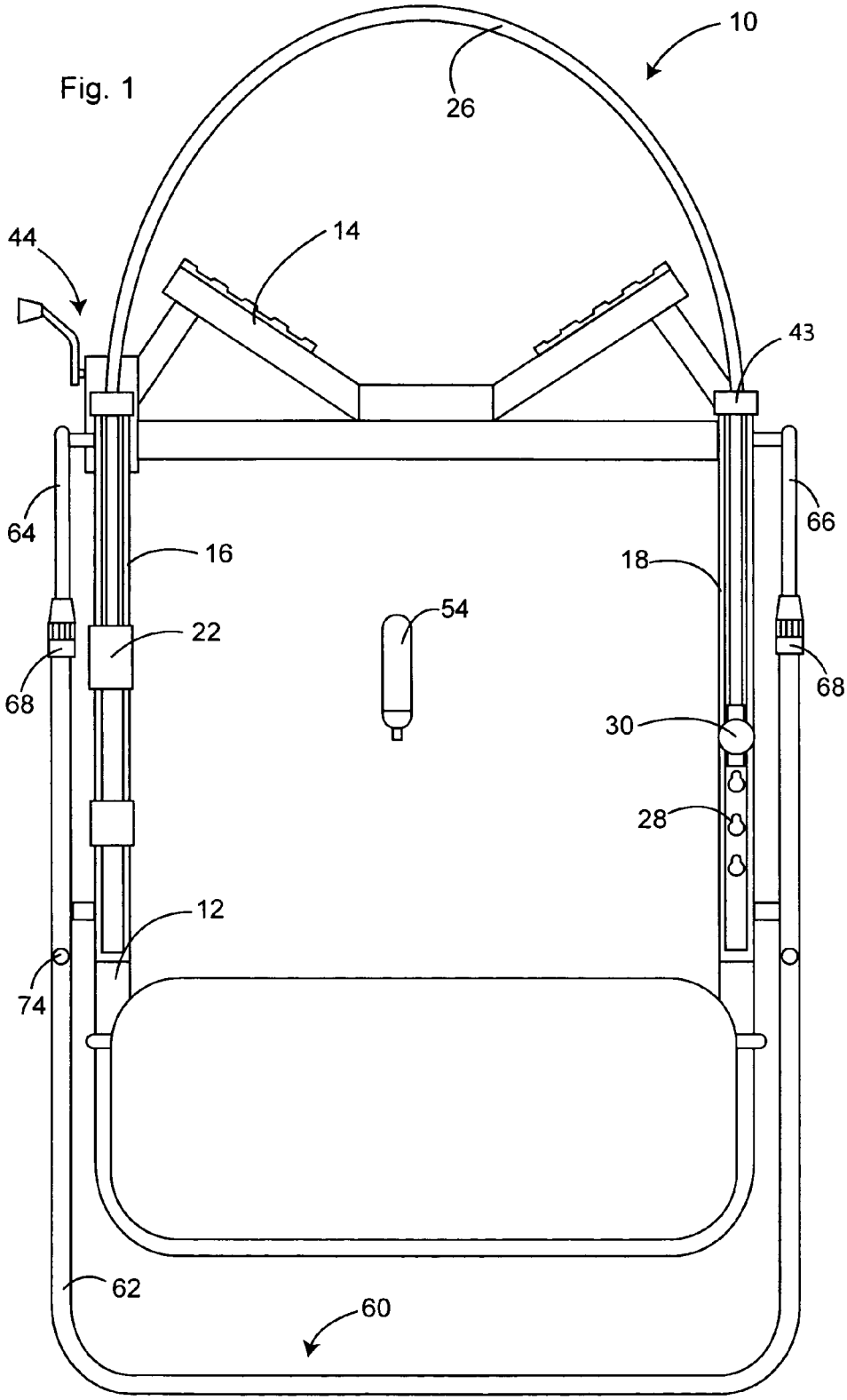
FIG. 1 is a top view of the seating section of a climbing tree stand.
Figure 2:
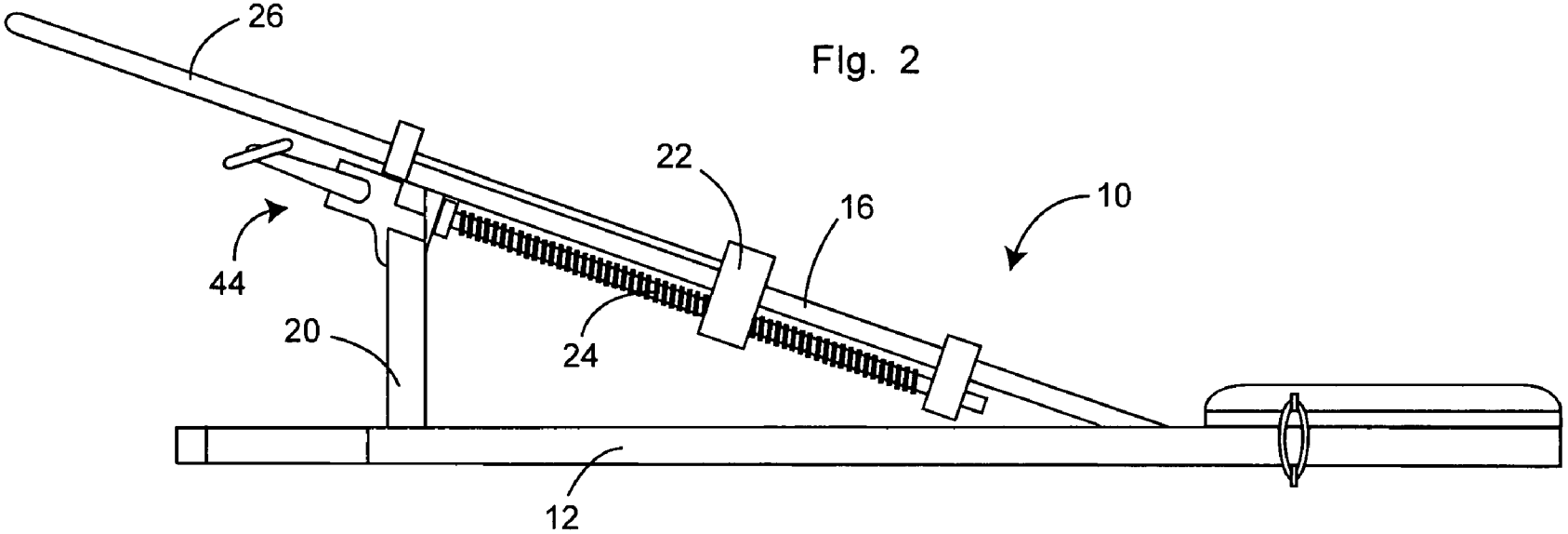
FIG. 2 is a side view of the seating section of a climbing tree stand with the safety rail removed to better illustrate the other components of the stand section.

As best seen in FIGS. 1 and 2, seating tree stand section, generally 10, of the present invention is comprised of a frame 12, usually a rectangular welded aluminum frame, having an inner or front end and an outer or rear end. Tree grippers 14 are secured to the inner end of frame 12. Left and right attachment arms 16 and 18, respectively, extend upwardly from the outer end of frame 12 toward the inner end of frame 12, with the inner end of each attachment arm 16 and 18 being joined to the inner end of frame 12 by connection uprights 20. Cable retainer 22 is slidably mounted on left attachment arm 16. Cable retainer 22 is attached to threaded rod 24, preferably an acme threaded rod, which is mounted parallel to left attachment arm 16. Right attachment arm 18 includes a plurality of equally spaced receiving openings 28 and pinholes 29.

Cable 26 has a first end including attachment handle 30 including projections 31 adapted for releasable insertion into selected openings 28 in arm 18, and a retractable locking pin for insertion into pinhole 29 to prevent removal of projections 31, and a second end terminating in connector 32. The construction and operation of attachment handle 30 is described in detail in commonly assigned U.S. Pat. No. 6,523,642, issued Feb. 25, 2003; U.S. Pat. No. 6,668,976, issued Dec. 30, 2003; and U.S. Pat. No. 6,698,549, issued May 2, 2004; all being incorporated herein by reference in their entirety. It will be understood that other means may be used to releasibly attach cable 26 to attachment arm 18.

Figure 8:
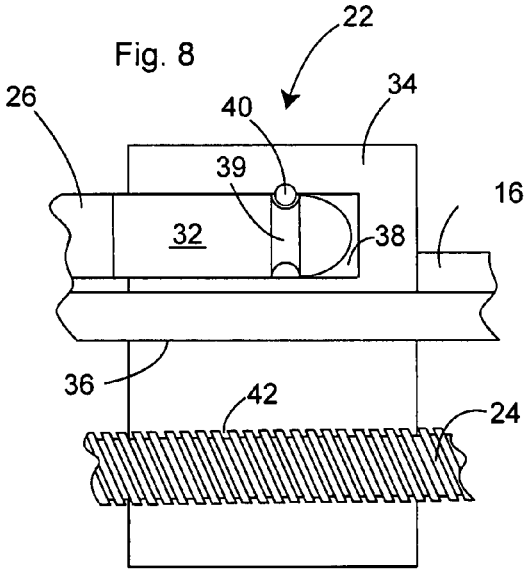
FIG. 8 is a detailed sectional side view of the cable retainer.
Figure 10:
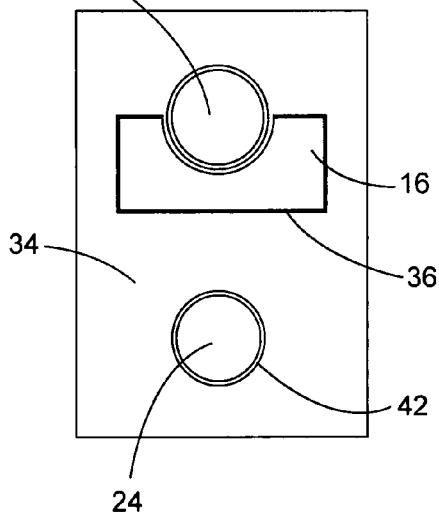
FIG. 10 is an end view of the cable retainer.
Figure 9:
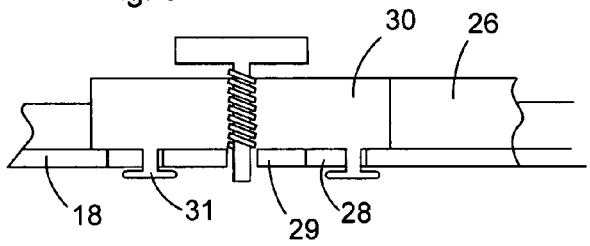
FIG. 9 is a sectional side view of the cable latching means.

As best seen in FIGS. 8 and 10, cable retainer 22 is comprised of a housing 34 that includes receiving channel 36 through which attachment arm 16 is inserted so that cable retainer 22 can slide along attachment arm 16, and connector receiving bore 38. Connector 32 includes a circumferential groove 39 that is releasibly engaged by pin 40 that is longitudinally moveable between engaged and disengaged positions within housing 34 transverse to cable 26. Cable retainer 22 also includes a threaded bore 42 surrounding and meshing with threaded rod 24.

Figure 5:
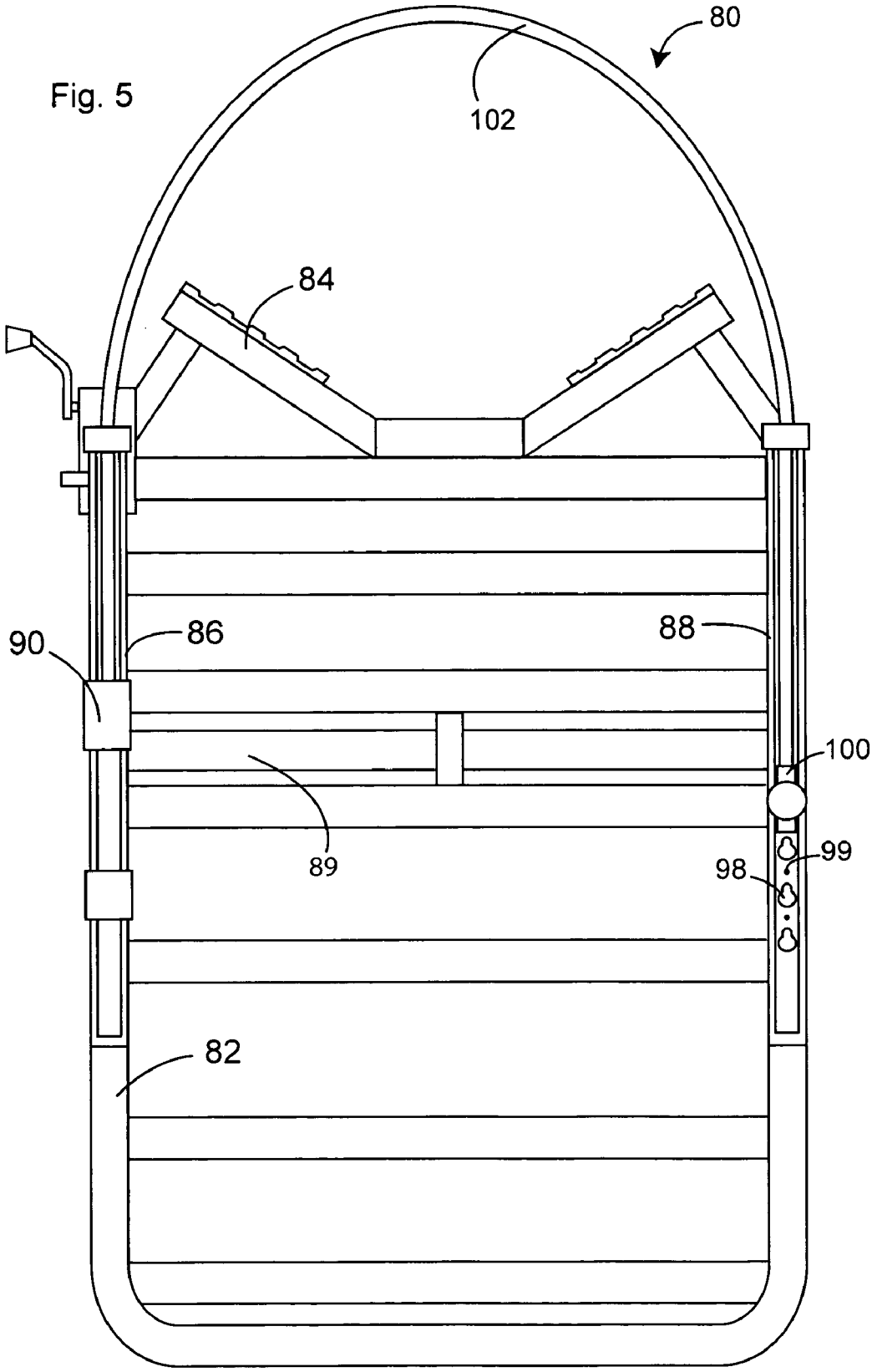
FIG. 5 is a top view of the standing section of a climbing tree stand.

Threaded rod 24 is rotated by manual winder 44, illustrated in detail in FIG. 5. Winder 44 is comprised of a detachable crank arm 46, insertable into chuck 48 to rotate first gear 50, which in turn rotates gear 52 and rod 24. Alternatively, gears 50 and 52 may be rotated by insertion of battery powered drive means 54 into chuck 48.

Figure 3:
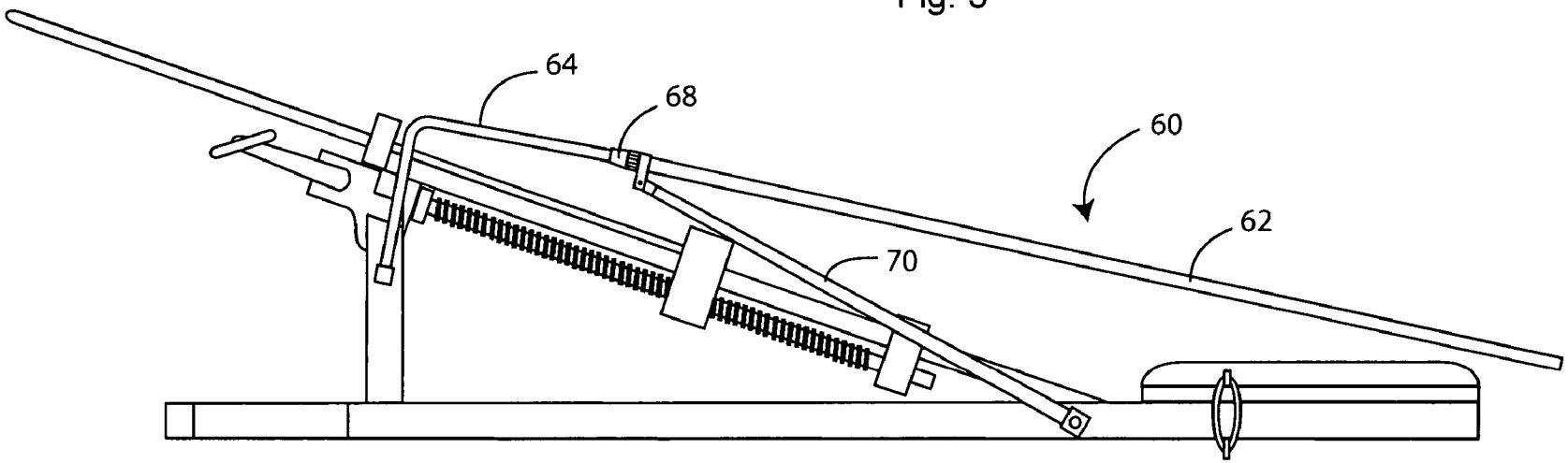
FIG. 3 is a side view of the seating section of a climbing tree stand with the safety rail in the lowered position for storage and transportation.
Figure 4:
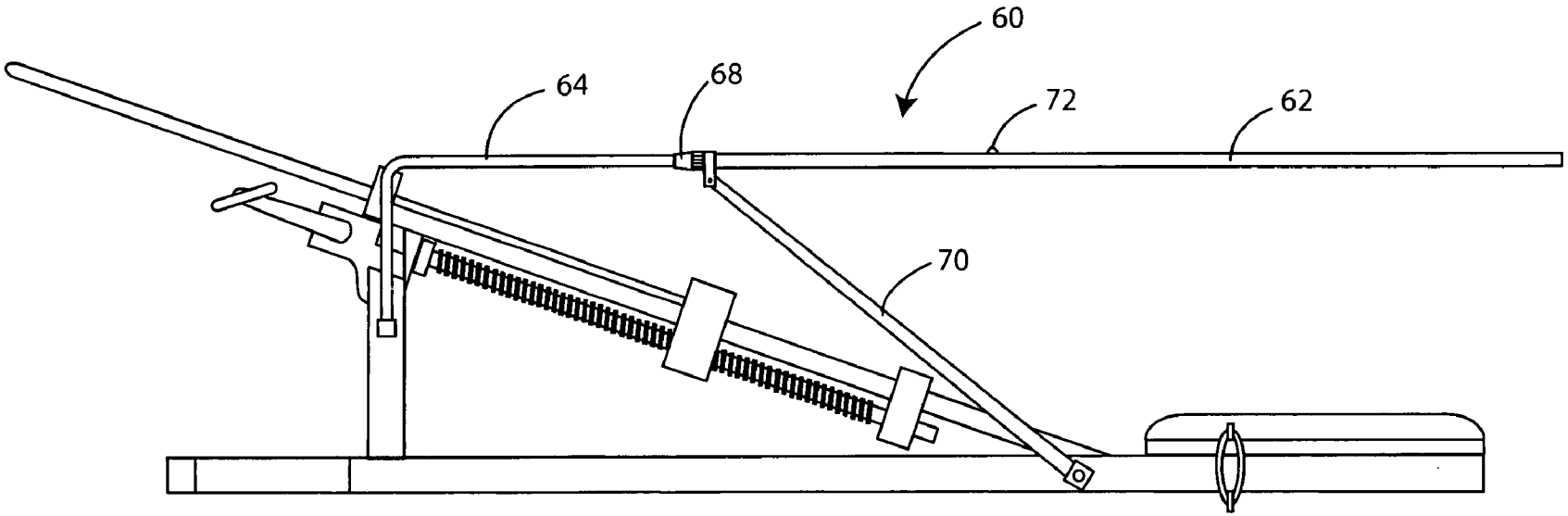
FIG. 4 is a side view of the seating section of a climbing tree stand with the safety rail in the raised operable position.

Seating section 10, as illustrated in FIGS. 1, 3 and 4, also includes adjustable safety rail, generally 60, comprised of a tubular outer U-shaped section 62 with first and second inner ends, and first and second pivotal inner arms 64 and 66 slidably insertable into the first and second inner ends, respectively, of section 62. Releasable locking members 68 secure arms 64 and 66 at fixed positions with respect to section 62. Safety rail 60 further includes support arms 70 having lower ends pivotally attached to frame 12 and upper ends pivotally attached to U-shaped section 62.

FIG. 3 illustrates safety rail 60 in its lowered position. Upon release of locking members 68, rail 60 can be raised to its operable position as illustrated in FIG. 4, telescoping inner arms 64 and 66 from U-shaped section 62. Spring-loaded locking buttons 72 extend outwardly from openings 74 in U-shaped section 62 when safety rail 60 is in its raised position, and are depressed to move section 62 back to the lowered position.

Figure 6:
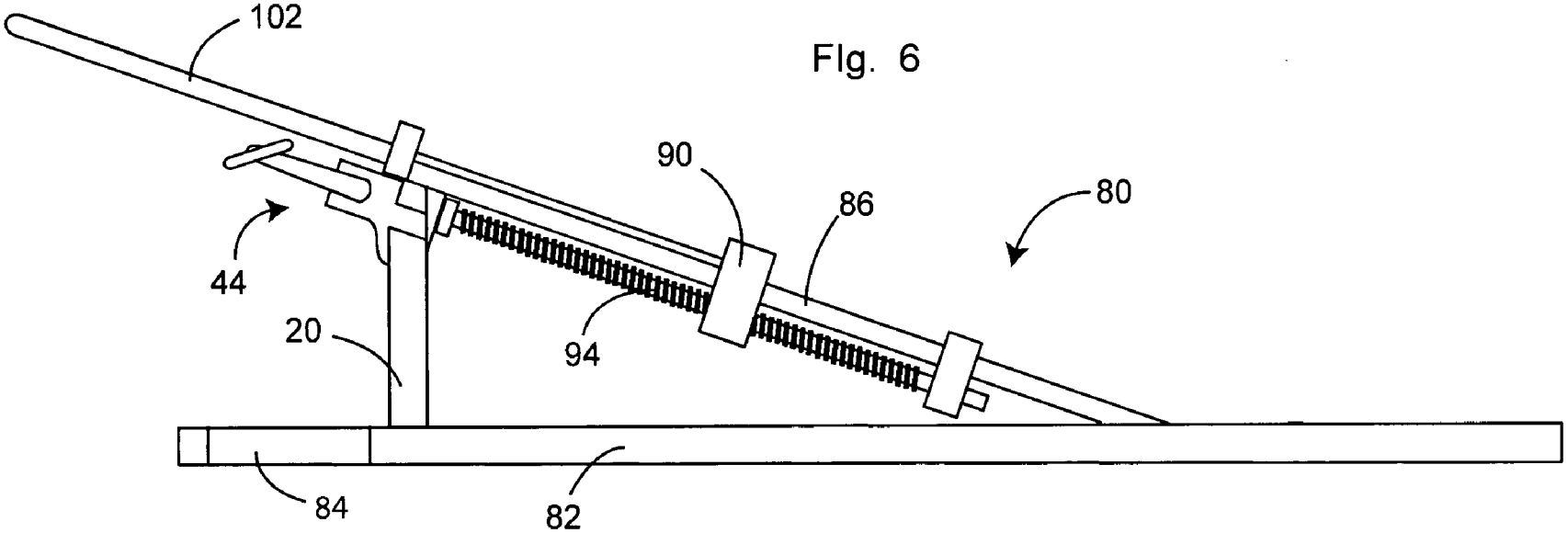
FIG. 6 is a side view of the standing section of a climbing tree stand.
Figure 7:
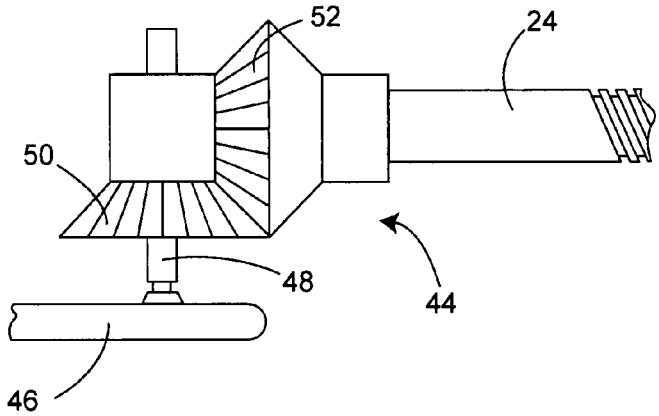
FIG. 7 is a detailed view of the drive gears used to rotate the threaded rod.

FIGS. 5 and 6 illustrate standing section of the tree stand, generally 80, which is similar in construction to seating section 10. Specifically, standing section 80 is comprised of a frame 82, grippers 84, left and right attachment arms 86 and 88, and foot restraint strap 89. Cable retainer 90 is slidably mounted on left attachment arm 86, and is slidably carried on threaded rod 94. Right attachment arm 96 includes a plurality of equally spaced receiving openings 98 and pinholes 99 for releasable attachment at selected positions of handle 100 at one end of cable 102. Cable retainer 90 has the same construction as cable retainer 22. At least one of the tree stand sections includes cable guides 43 adjacent the inner ends of its first and second attachment arms.

As a climber ascends a tree, the diameter of the tree trunk will decrease, causing the outer ends of tree stand sections 10 and 80 to tilt downward. To level section 10, the climber merely rotates rod 24 with manual winder 44 or electrical drive means 54. Rotation of rod 24 in a first direction, either clockwise or counterclockwise depending on the design of the tree stand and tool, causes cable retainer 22 to slide along attachment arm 16 toward the outer end of tree stand 10, tightening cable 26 around the tree. When descending the tree, cable 26 is loosened by pushing downward on the rear of seating section 10, while rotating rod 24 in the opposite direction. In a similar manner standing section 80 is leveled by rotating rod 94.

Certain modifications and improvements will occur to those skilled in the art upon a reading of the foregoing description. For example, a locking mechanism can be added to prevent rotation of the threaded rod, if needed. Also, the configuration of either frame may be reversed, with the cable retainer being placed on the right attachment arm. It should be understood that all such modifications and improvements have been deleted herein for the sake of conciseness and readability but are properly within the scope of the invention.

What is claimed is:

1. A tree stand including a seating section and a standing section, at least one of said sections comprising:

a) a frame having first and second sides, inner and outer ends, and a first cable attachment arm with inner and outer ends along said first side;

b) a rotatable threaded rod mounted parallel to said first attachment arm;

c) a cable retainer including a housing with a first bore for receiving said attachment arm and a threaded bore for receiving said threaded rod moveable along said first attachment arm upon rotation of said threaded rod;

d) drive means for rotating said threaded rod; and e) a cable having a first end releasibly attachable to said cable retainer and a second end attachable to said frame.

2. The tree stand of claim 1, wherein said drive means is comprised of a manually rotatable handle and gears connecting said handle to one end of said threaded rod.

3. The tree stand of claim 1, wherein said frame further includes a second cable attachment arm with inner and outer ends along said second side parallel to said first cable attachment arm, said cable second end being releasibly attachable to said second attachment arm.

4. The tree stand of claim 1, wherein said first attachment arm is a longitudinal bar with a trough for receiving said cable.

5. The tree stand of claim 1, wherein said second attachment arm has opposed surfaces, and a plurality of spaced holes extending between said upper and lower surfaces, and said cable second end includes a handle positionable on the upper surface of said second attachment arm, said handle including projections releasibly attachable in selected holes in said second attachment arm.

6. The tree stand of claim 1, wherein said cable includes a connector at its first end and said cable retainer includes a bore to receive said connector and a locking means to releasibly lock said connector in said bore.

7. A tree stand including a seating section and a standing section, at least one of said sections comprising:

a) a frame having first and second sides, inner and outer ends, a first cable attachment arm with inner and outer ends along said first side, and a second cable attachment arm with inner and outer ends along said second side;

b) a rotatable threaded rod mounted parallel to said first attachment arm;

c) a releasable cable retainer including a channel for receiving said attachment arm and a threaded bore for receiving said threaded rod, said retainer being moveable along said first attachment arm upon rotation of said threaded rod;

d) drive means for rotating said threaded rod; and e) a cable having a first end releasibly attachable to said cable retainer and a second end attachable to said second attachment arm.

8. The tree stand of claim 7, wherein said second attachment arm has upper and lower surfaces, and a plurality of spaced holes extending between said upper and lower surfaces, and said cable second end includes a handle positionable on the upper surface of said second attachment arm, said handle including projections releasibly attachable in selected holes in said second attachment arm.

9. The tree stand of claim 7, wherein said cable includes a connector at its first end and said cable retainer includes a bore to receive said connector and a locking means to releasibly lock said connector in said bore.

10. The tree stand of claim 7, wherein said drive means is comprised of a manually rotatable handle and gears connecting said handle to one end of said threaded rod.

11. The tree stand of claim 7, wherein said threaded rod is an acme threaded rod.

12. The tree stand of claim 7, wherein said first and second attachment arms are bars having upper and lower surfaces, and axially aligned troughs in said upper surfaces for receiving said cable.

13. The tree stand of claim 7, wherein said section includes cable guides adjacent the inner ends of said first and second attachment arms.

* * * * *